US010079445B2

(12) United States Patent
Matsui et al.

(10) Patent No.: US 10,079,445 B2
(45) Date of Patent: Sep. 18, 2018

(54) ELECTRICAL CONNECTOR FOR A TWISTED PAIR CABLE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Yasuo Omori, Mie (JP)

(73) Assignees: AUTONETWORKS TECHNOLOGIES, LTD., Yokkaichi, Mie (JP); SUMITOMO WIRING SYSTEMS, LTS., Yokkaichi, Mie; SUMITOMO ELECTRIC INDUSTRIES, LTD., Osaka-shi, Osaka ( * ) Notice: Subject to any disclaimer, the term of this patent is extended or adjusted under 35 U.S.C. 154(b) by 3 days.

(21) Appl. No.: 15/537,999

(22) PCT Filed: Jan. 5, 2016

(86) PCT No.: PCT/JP2016/050171
§ 371 (c)(1),
(2) Date: Jun. 20, 2017

(87) PCT Pub. No.: WO2016/114179
PCT Pub. Date: Jul. 21, 2016

(65) Prior Publication Data

US 2017/0352975 A1 Dec. 7, 2017

(30) Foreign Application Priority Data

Jan. 13, 2015 (JP) ..... 2015-003833

(51) Int. Cl.
*H01R 13/434* (2006.01)
*H01R 13/426* (2006.01)
(Continued)

(52) U.S. Cl.
CPC ..... *H01R 13/426* (2013.01); *H01R 11/00* (2013.01); *H01R 13/4223* (2013.01);
(Continued)

(58) Field of Classification Search
CPC ..... H01R 11/00; H01R 13/4223; H01R 13/4226; H01R 13/4362; H01R 25/003; H01R 13/434
(Continued)

(56) References Cited

U.S. PATENT DOCUMENTS 5,120,269 A * 6/1992 Endo ..... H01R 13/4368 439/595
7,520,767 B2 * 4/2009 Tamagawa ..... H01R 12/592 439/189
9,905,978 B2 * 2/2018 Zebhauser ..... H01R 24/38

FOREIGN PATENT DOCUMENTS

JP 2001/184954 7/2001
JP 2001-326011 11/2001
(Continued)

OTHER PUBLICATIONS

International Search Report dated Apr. 5, 2016.

*Primary Examiner* — Abdullah Riyami
*Assistant Examiner* — Justin Kratt
(74) *Attorney, Agent, or Firm* — Gerald E. Hespos; Michael J. Porco; Matthew T. Hespos

(57) ABSTRACT

It is aimed to prevent a noise reduction function of a twisted pair cable from being reduced near the entrances of cavities. A connector (CO) includes a twisted pair cable formed by twisting a pair of wires, female terminals (9A, 9B) con-
(Continued)

nected to respective ends of both wires (W) of the twisted pair cable, a housing (15) formed with cavities (18) for individually accommodating the female terminals (9A, 9B), and a locking lance (13) deflectably arranged in the housing (15) and capable of locking the female terminals (9A, 9B). A pair of the female terminals (9A, 9B) connected to the both wires (W) of the twisted pair cable are accommodated into the cavities (18) adjacent in a Y direction and the locking lance (13) integrally and interlockably formed to straddle between the adjacent cavities (18) is formed in the adjacent cavities (18).

6 Claims, 19 Drawing Sheets

(51) Int. Cl.
*H01R 11/00* (2006.01)
*H01R 13/422* (2006.01)
*H01R 13/436* (2006.01)
*H01R 25/00* (2006.01)

(52) U.S. Cl.
CPC ..... *H01R 13/4226* (2013.01); *H01R 13/434* (2013.01); *H01R 13/4362* (2013.01); *H01R 25/003* (2013.01)

(58) Field of Classification Search
USPC ..... 439/595, 752, 502, 623, 871
See application file for complete search history.

(56) References Cited

FOREIGN PATENT DOCUMENTS

| | | |
|---|---|---|
| JP | 2011-18543 | 1/2011 |
| JP | 2014-82009 | 5/2014 |

* cited by examiner

ELECTRICAL CONNECTOR FOR A TWISTED PAIR CABLE

BACKGROUND

1. Field of the Invention

The present invention relates to a connector, particularly to a connector to which a twisted pair cable is to be connected.

2. Description of the Related Art

A cable formed by twisting two wires is called a twisted pair cable and is used in a circuit required to shield the influence of noise in some cases. Terminals are connected to ends of the respective wires of such a twisted pair cable and are accommodated in adjacent cavities of a housing of a connector. Such a technique is disclosed, for example, in Japanese Unexamined Patent Publication No. 2001-184954.

Each terminal of the above-described connector that has been accommodated properly into the corresponding cavity is locked and retained by a locking lance separately provided in the cavity as in normal connectors. However, there has been a high request for the miniaturization of terminals and, accordingly, locking lances also have been miniaturized in recent years. Thus, maintaining a terminal holding force is a problem.

On the other hand, tests are conducted to determine whether the terminals connected to the respective wires of the twisted pair cable are retained and accommodated properly in the cavities. Specifically, a test is conducted by individually applying a pull-out force to each wire of the twisted pair cable. However, the wires of the twisted pair cable are close to one another, and a worker tends to grip both wires and simultaneously pull them out even though he tries to individually pull out each wire. In such a case, one terminal may be locked properly while the terminal connected to the other wire is inserted incompletely. In this situation, neither of the terminals is pulled out.

Conventionally, to deal with this situation, the respective wires are untwisted over a certain length range in their parts before the entrances of the cavities. Thus, a noise reduction function of the twisted pair cable may be impaired in the untwisted range.

The present invention was completed in view of the above situation and aims to provide a connector capable of maintaining a noise reduction function of a twisted pair cable and obtaining a sufficient terminal holding force.

SUMMARY

The present invention is directed to a connector with a twisted pair cable formed by twisting a pair of wires, and terminals are connected to respective ends of the twisted pair cable. A housing is formed with cavities for individually accommodating the terminals, and a deflectable locking lance is arranged in the housing and for locking the terminals. Two of the terminals connected to the twisted pair cable are accommodated into adjacent cavities and the locking lance integrally and interlockably straddles between the adjacent cavities.

In the connector of the present invention, the terminals connected to the respective ends of the twisted pair cable are inserted simultaneously into the corresponding pair of cavities. Then, the terminals move forward while deflecting the integrally formed locking lance. When the respective terminals are inserted properly into the cavities, the terminals substantially simultaneously are locked resiliently by the locking lance. In this way, the locking lance can be enlarged in a width direction so as to be shared by the terminal pair. Thus, the rigidity of the locking lance itself can be enhanced and a terminal holding force can be improved.

Further, after the insertion of the terminals, a pull-out force is applied to the twisted pair cable to test whether or not the terminals are locked properly by the locking lance. If either one of the pair of terminals is inserted incompletely, the locking lance is in a deflected state. Thus, the terminals are pulled out together from the cavities, and it is detected that at least one of the terminals was in an incompletely inserted state.

Further, both wires of the twisted pair cable are pulled together according to the present invention. Thus, it is not necessary to untwist the twisted pair cable over a length range as before, and a noise reduction function is maintained.

A common unlocking portion for unlocking the terminals may be formed in a front part of the locking lance. According to this configuration, if the locking lance is deflected and deformed in an unlocking direction by operating the common unlocking portion, the terminals connected to the twisted pair cable can be pulled out simultaneously.

Two removal holes for molding both side surface parts of the locking lance may be open in side surfaces of the housing. The removal holes communicate with a retainer mount hole for mounting a retainer for locking the terminals, and openings of the removal holes are closed by the retainer with the retainer mounted in the housing. According to this configuration, the retainer closes the removal holes to prevent the entrance of an external matter into the housing and to avoid an inadvertent operation of the locking lance.

An arrangement direction of the cavities for accommodating the terminals connected to the twisted pair cable may be set in a direction perpendicular to a deflection direction of the locking lance. According to this configuration, an interval between the cavities for accommodating the pair of terminals can be narrowed. Thus, a high noise removal function of the twisted pair cable can be maintained also in the cavities.

DETAILED DESCRIPTION

A specific embodiment of a connector of the present invention is described with reference to the drawings.

(Summary of In-Vehicle Network)

This embodiment is described, taking a joint connector used in an in-vehicle network as an example.

Figure 1:
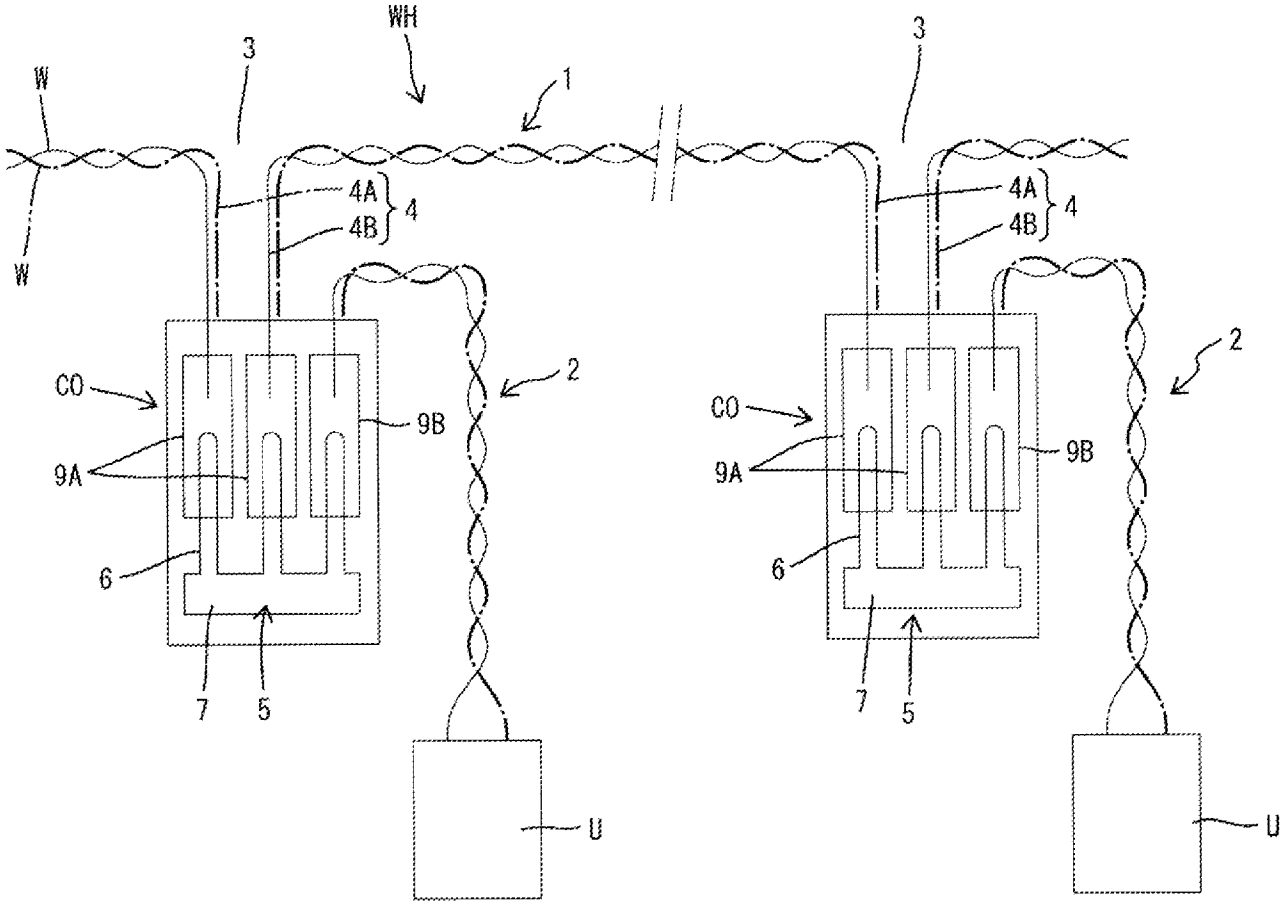
FIG. 1 is a view showing a part of an in-vehicle network.

FIG. 1 shows a part of the in-vehicle network called CAN (Control Area Network), and a plurality of electronic control units U can communicate with each other via a wiring harness WH.

The wiring harness WH is composed of a main line 1 and branch lines 2 branched from this main line 1 at a plurality of branch points 3 and connected to the respective electronic control units U at respective branch destinations. Further, the main line 1 and each branch line 2 are constituted by twisted pair cables formed by twisting a pair of wires W.

The main line 1 is formed with bypasses 4 toward joint connectors CO at the respective branch points 3. A forward path 4A and a return path 4B in each bypass 4 are relayed in the joint connector CO and branched toward each electronic control unit U.

(Joint Terminal: See FIG. 2)

Figure 2:
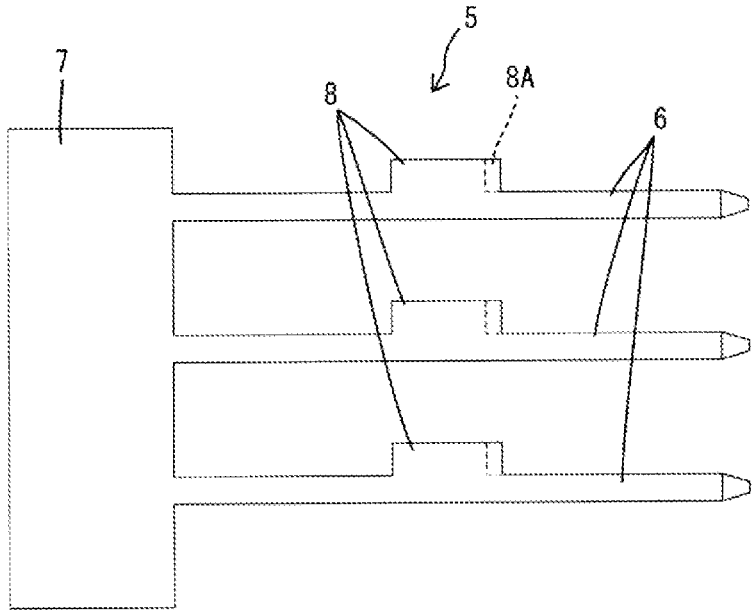
FIG. 2 is a plan view of a joint terminal.

Two joint terminals 5 shown in FIG. 2 are accommodated in the joint connector CO (only one joint terminal 5 is shown in FIG. 1). Each joint terminal 5 is made of conductive metal and formed of three tab terminals 6 juxtaposed in a width direction and a coupling piece 7 in the form of a flat plate coupling end parts of these tab terminals 6. The wires W paired in the above twisted pair cable are connected respectively to the tab terminals 6 paired between the joint terminals 5 via female terminals 9A, 9B.

A substantially rectangular follower portion 8 protrudes on one side edge of a central part of each tab terminal 6 in a length direction. A chamfered portion 8A in the form of a curved surface is formed on a front edge part of each follower portion 8. The chamfered portion 8A achieves a smooth entrance into a cam portion 27 to be described later.

The joint terminal 5 is punched out from a base material in the form of a flat plate by a press. Thus, both side edges of the tab terminals 6 are fracture surfaces. When being punched out by the press, plate surfaces (top and under surfaces shown in FIG. 2) of the tab terminals 6 are on the same planes as plate surfaces of the coupling piece 7 as shown in FIG. 2. However, after being incorporated into the joint connector CO, the respective tab terminals 6 are twisted by 90° about axes thereof and the plate surfaces of the coupling piece 7 and those of the tab terminals 6 are in a substantially perpendicular positional relationship. This is described in detail later.

Figure 3:
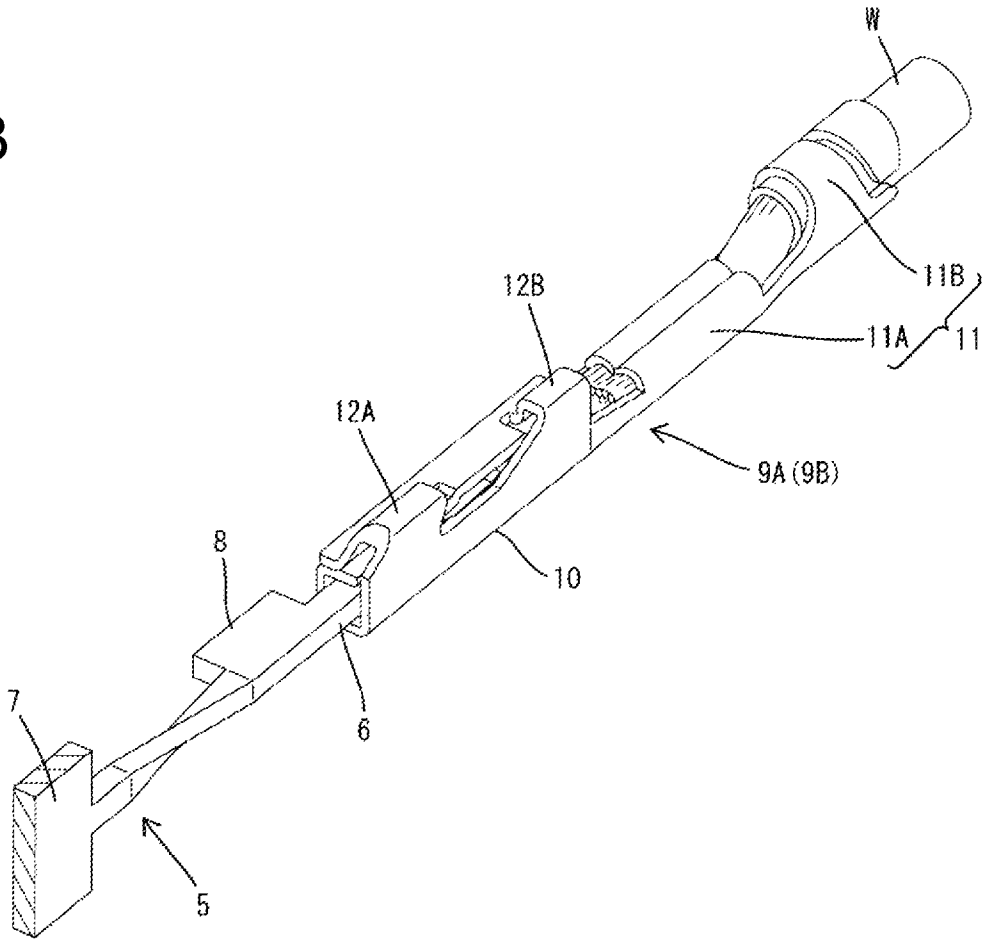
FIG. 3 is a perspective view showing a connected state of the twisted joint terminal and a female terminal.

(Female Terminal: See FIG. 3)

The same female terminals 9A, 9B are used for each of the main line and the branch lines. The female terminals 9A, 9B also are bent into a predetermined shape after being punched out from a conductive metal plate material by a press. The female terminal 9A, 9B is composed of a terminal connecting portion 10 in the form of a rectangular tube, into which the tab terminal 6 is insertable, and a wire connecting portion 11 arranged behind the terminal connecting portion 10. The wire connecting portion 11 is composed of a wire barrel 11A to be crimped to a core exposed at an end part of the wire (each wire constituting the twisted pair cable) and an insulation barrel 11B to be crimped to a coating part of the wire W.

The terminal connecting portion 10 is formed by being bent into a rectangular tube shape and a ceiling is a double wall. An outer surface of the ceiling of the terminal connecting portion 10 is cut in a central part in a longitudinal direction, thereby having a single wall structure. Two protrusions 12A, 12B project at front and rear sides of this cut part on the outer surface of the ceiling in the terminal connecting portion 10. The protrusions 12A, 12B function as stabilizers and the front protrusion 12A also has a function of locking together with a locking lance 13 to be described later.

Figure 4:
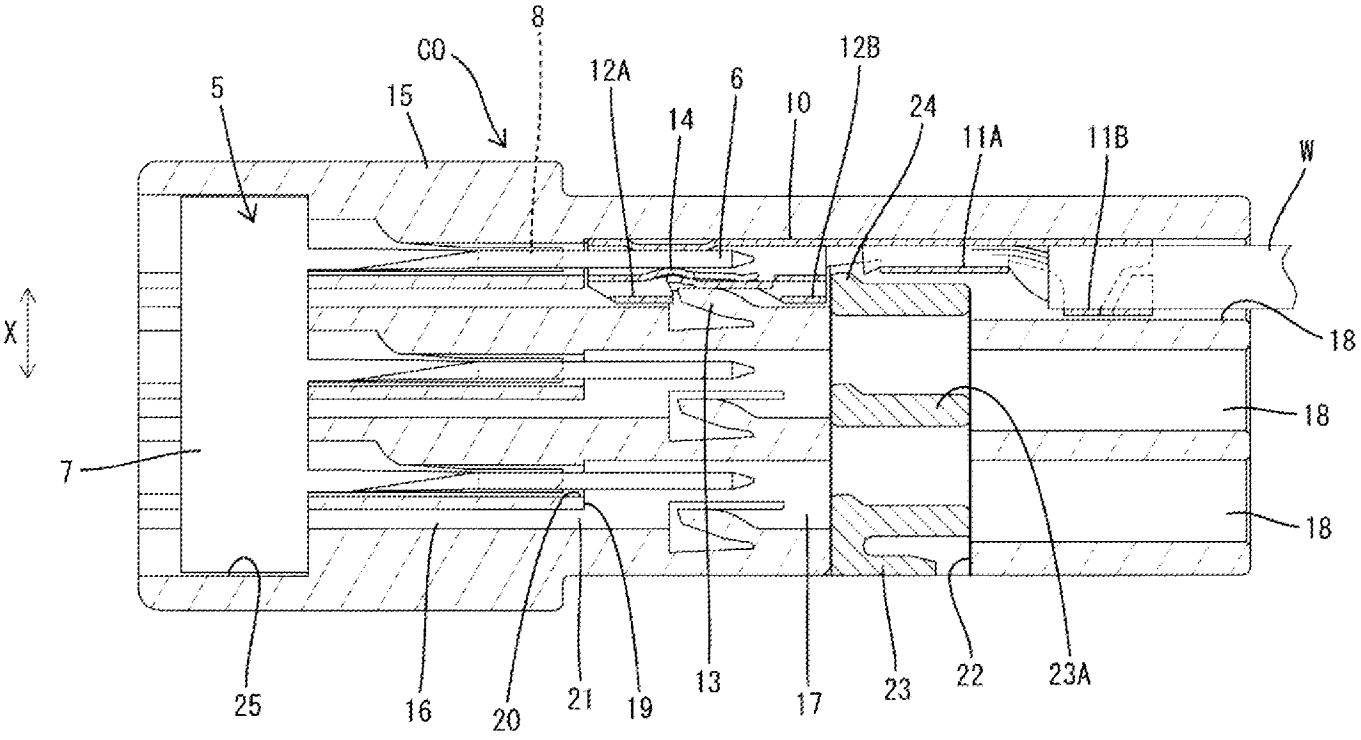
FIG. 4 is a section of a joint connector in a state where the joint terminal and the female terminals are connected.

Further, as shown in FIG. 4, a resilient contact piece 14 to be connected electrically to each tab terminal 6 of the joint terminal 5 is formed inside the terminal connecting portion 10. As shown in FIG. 4, the resilient contact piece 14 is cantilevered rearwardly and deflectable in a direction opposite to a projecting direction of the protrusions 12A, 12B. In other words, the resilient contact piece 14 is deflected along a deflection direction of the locking lance 13 (X direction: see FIGS. 4 and 6).

(Connector Housing: See Mainly FIGS. 4 to 8)

The housing 15 is made of synthetic resin and is formed internally with a pair of first terminal accommodating portions 16 (accommodating portion located on a left side in the housing 15 in FIG. 4 and only the first terminal accommodating portion 16 on one side is shown in FIG. 4) for accommodating the pair of joint terminals 5 and a pair of second terminal accommodating portions 17 (accommodating portion located on a right side in the housing in FIG. 4 and only the second terminal accommodating portion 17 on one side is shown in FIG. 4) for accommodating a total of three pairs of female terminals (two pairs of main line female terminals 9A and one pair of branch line female terminals 9B). Each second terminal accommodating portion 17 includes a total of three cavities 18 for accommodating two main line female terminals 9A and one branch line female terminal 9B.

Figure 6:
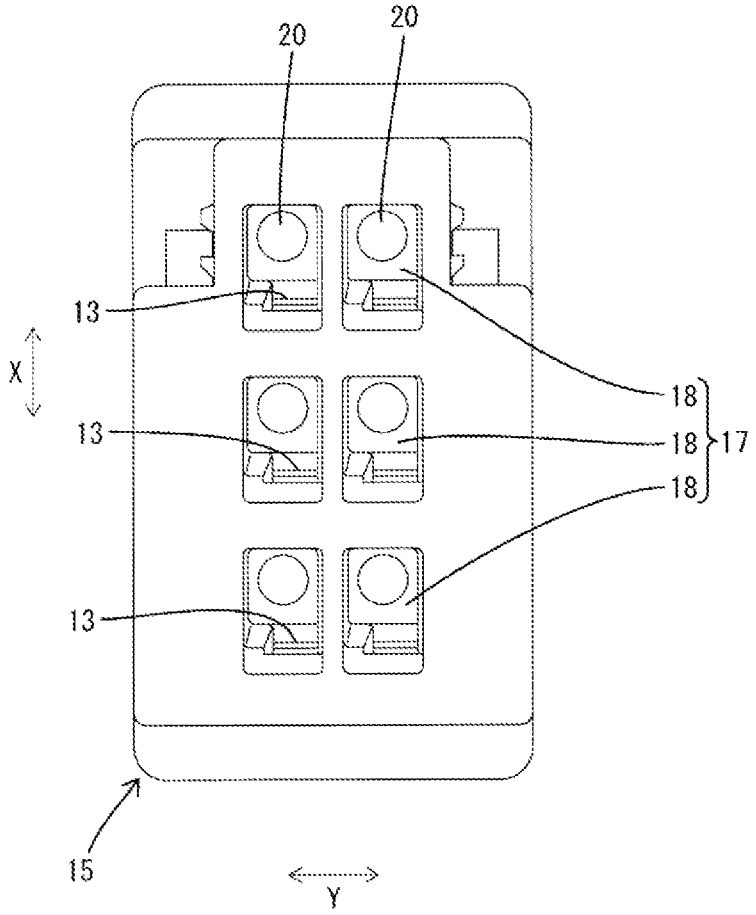
FIG. 6 is a right side view of the housing.

As shown in FIG. 6, pairs of female terminals (main line female terminals 9A and branch line female terminals 9B) connected to the wires W constituting the twisted pair cables are accommodated in the cavities 18 adjacent in a lateral direction shown in FIG. 6 (Y direction in FIG. 6) in the pair of second terminal accommodating portions 17. As shown in FIG. 6, an interval between the cavities 18 constituting the respective second terminal accommodating portions 17 in the Y direction is narrower than an interval between the cavities 18 in the X direction.

Further, as shown in FIG. 4, insertion holes 20 for allowing the passage of the tab terminals 6 and through holes 21 used to mold common unlocking portions 30 in front end central parts of the locking lances 13 or unlock the locking lances 13 are open in boundary walls 19 between the respective second terminal accommodating portions 17 and the corresponding first terminal accommodating portions 16. These through holes 21 communicate with the first terminal accommodating portions 16 along the front-rear direction in the housing 15.

(Locking Lance: See Mainly FIGS. 17 to 19)

Figure 17:
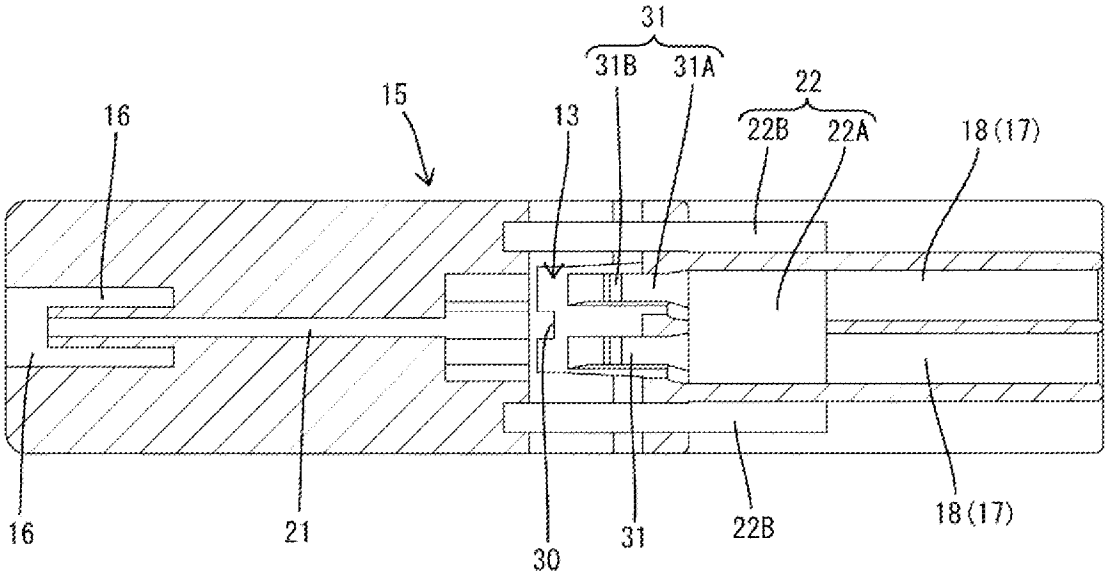
FIG. 17 is a plan view in section of the housing showing a locking lance part.
Figure 18:
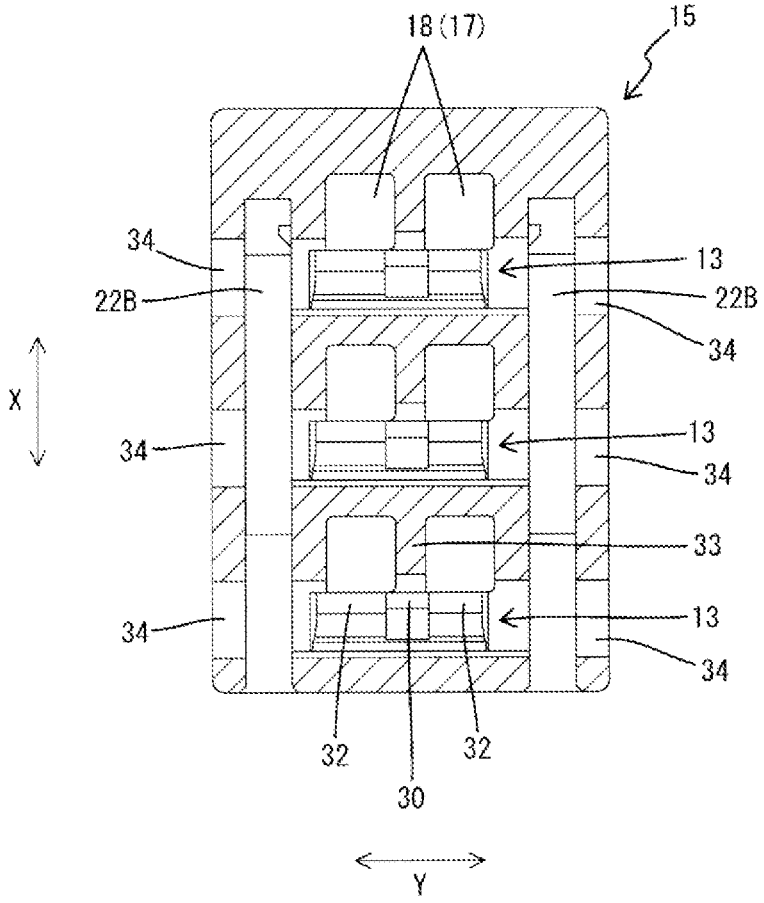
FIG. 18 is a side view in section showing the locking lance part viewed from the side of the first terminal accommodating portion.
Figure 19:
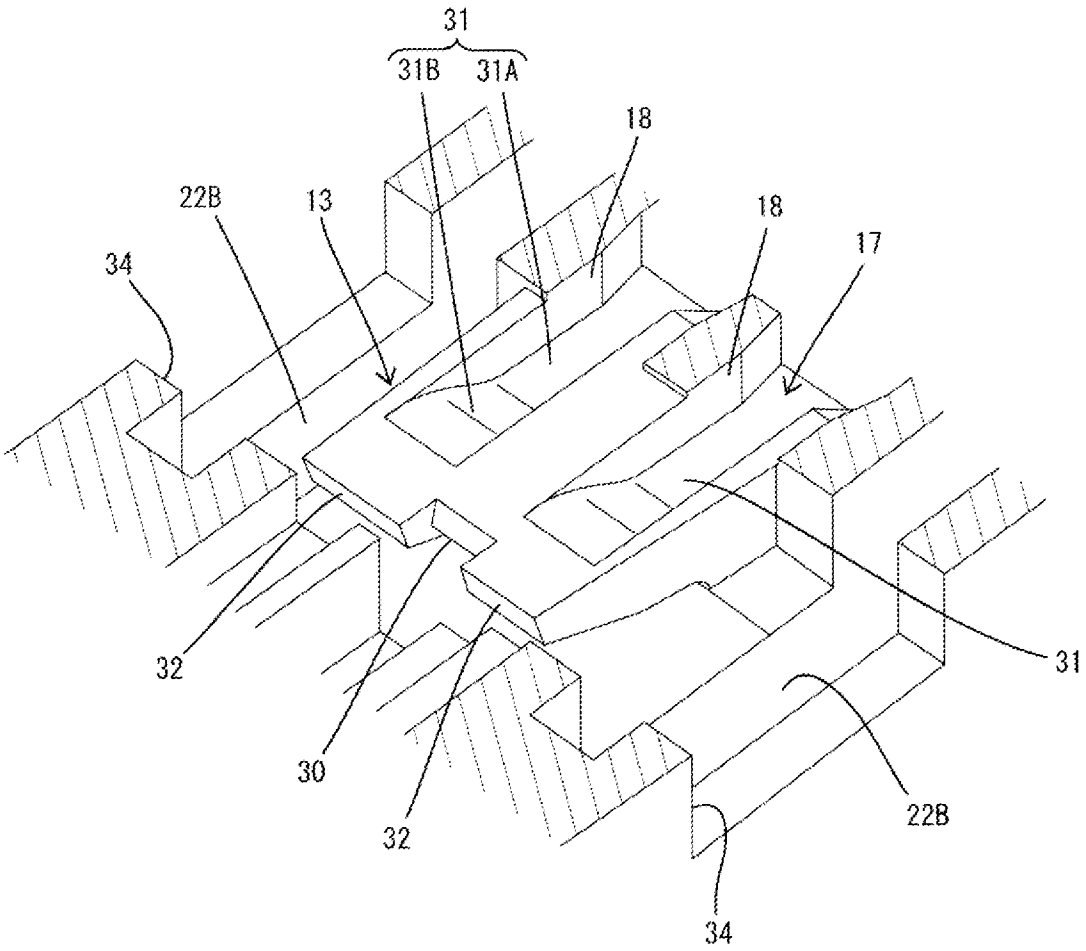
FIG. 19 is a perspective view showing the locking lance part in section.

The locking lances 13 for simultaneously locking the pair of the female terminals 9A, 9B connected to the respective wires W of the twisted pair cable are provided in the housing 15 in front of a body portion accommodating portion 22A (see FIG. 5) of a retainer mounting hole 22 to be described later. Three locking lances 13 are arranged in the X direction in the second terminal accommodating portion 17. Each locking lance 13 is cantilevered forward as shown in FIGS. 17 to 19. Further, each locking lance 13 has a width to straddle between the cavities 18 adjacent in the Y direction, deflectable and deformable along the X direction and integrally formed to be able to collectively lock the pair of female terminal fittings 9A, 9B accommodated in the cavities 18 that are adjacent in the Y direction.

As shown in FIG. 19, two escaping recesses 31 are formed in areas of the upper surface of the locking lance 13 where the protrusions 12A of the female terminals 9A, 9B pass. The escaping recesses 31 are formed along the front-rear direction over a range from the rear end of the locking lance 13 to a position slightly behind the front end. The escaping recesses 31 are substantially horizontal from the rear end to a central part, thereby forming horizontal recesses 31A in which the rear protrusions 12B are located with the female terminals 9A, 9B locked by the locking lance, but are formed with gradually upwardly inclined slopes 31B from the central part to the front end. A central part of the front end surface of the locking lance is cut backwardly and the aforementioned common unlocking portion 30 is formed on a back surface.

Two locking surfaces 32 are formed across the aforementioned common unlocking portion 30 in the width direction on the front end surface of the locking lance 13 and respectively are capable of locking the front protrusions 12A of the corresponding female terminals 9A, 9B. In unlocking the pair of female terminals 9A, 9B, an unlocking tool (not shown) in the form of a long bar is inserted into the through hole 21 from the side of the first terminal accommodating portions 16 to operate the common unlocking portion 30 so that the locking lance 13 is deflected in an unlocking direction.

As shown in FIG. 18, each locking lance 13 is formed to be slightly displaced in a leftward direction with respect to the cavities 18 adjacent in the Y direction. As shown in FIG. 18, a partition wall 33 between the cavities 18 and the common unlocking portion 30 are in a positional relationship to correspond in the width direction. Further, the right locking surfaces 32 in FIG. 18 is in a positional relationship to be aligned with the corresponding cavity 18 in the width direction and is formed to have a slightly smaller width than this cavity 18, but the left locking surface 32 is in a positional relationship to be slightly displaced leftward with respect to the corresponding cavity 18 and is formed to have substantially the same width as this cavity 18.

Further, as shown in FIGS. 17 and 18, a total of three removal holes 34 are open for the respective locking lances 13 on each side surface of the housing 15 to mold front sides of both widthwise side surfaces of the respective locking lances 13. Thus, in a single state of the housing 15, the side surfaces of the front side of each locking lance 13 are exposed to the outside through the respective removal holes 34. On the other hand, the respective removal holes 34 communicate with both leg portion accommodating portions 22B of the retainer mount hole 22. When a retainer 23 is mounted properly into the housing 15, legs of the retainer 23 can close the respective removal holes 34 to conceal the respective locking lances 13.

Figure 5:
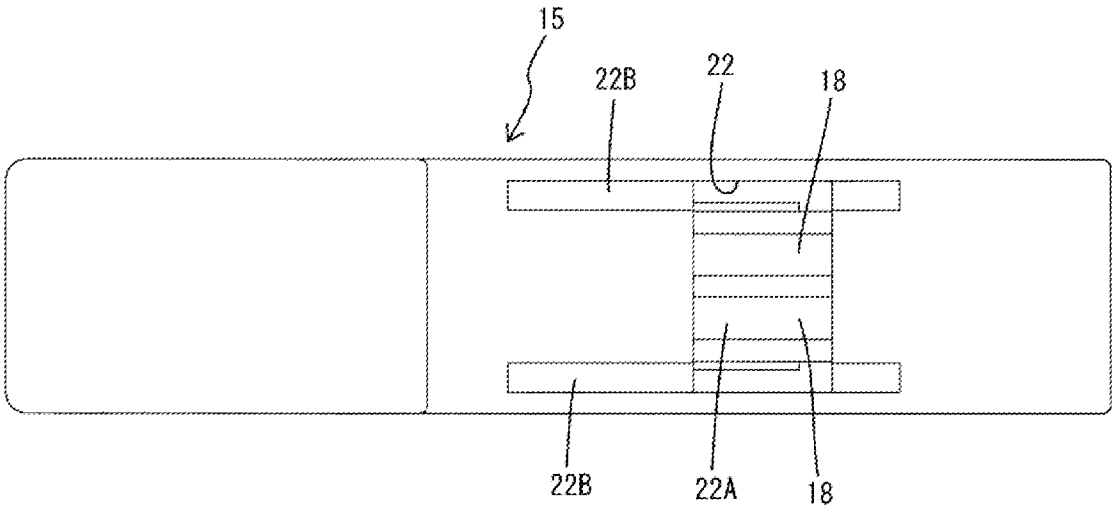
FIG. 5 is a bottom view of a housing.

Further, as shown in FIG. 5, the retainer mount hole 22 is open in one side surface of the housing 15. The retainer mount hole 22 communicates with all of the cavities 18. The retainer mount hole 22 is composed of the body accommodating portion 22A aligned with a body 23A of the retainer 23 to accommodate the body 23A and two leg accommodating portions 22B arranged to communicate with opposite widthwise sides of the body accommodating portion 22A to accommodate both legs (not shown in detail) of the retainer 23.

On the other hand, the body 23A of the retainer 23 to be mounted into this retainer mount hole 22 is formed into a frame shape to enable the female terminals 9A, 9B to pass therethrough, and each frame portion is formed with a locking projection 24 capable of locking the rear end of the terminal connecting portion 10 of each female terminal 9A, 9B. Further, although not shown in detail, the both legs of the retainer 23 are locked at two depth positions in the corresponding leg accommodating portions 22B, with the result that the retainer 23 is held at two positions, i.e. a partial locking position and a full locking position with respect to the housing 15. At the partial locking position, each locking projection 24 waits outside an entrance path for the female terminal 9A, 9B so that each female terminal 9A, 9B is inserted freely into and withdrawn from the cavity 18. However, at the full locking position, each locking projection 24 projects into the entrance path for the female terminal 9A, 9B, thereby being able to lock the rear end of the terminal connecting portion 10.

Figure 7:
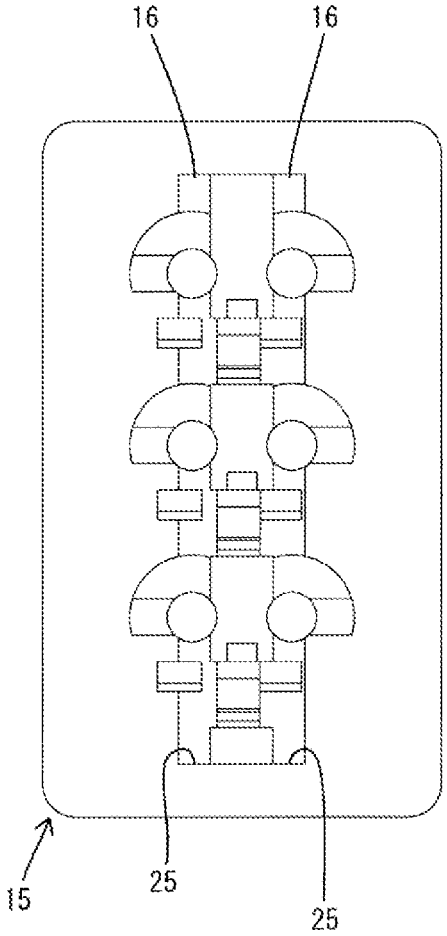
FIG. 7 is a left side view of the housing.
Figure 8:
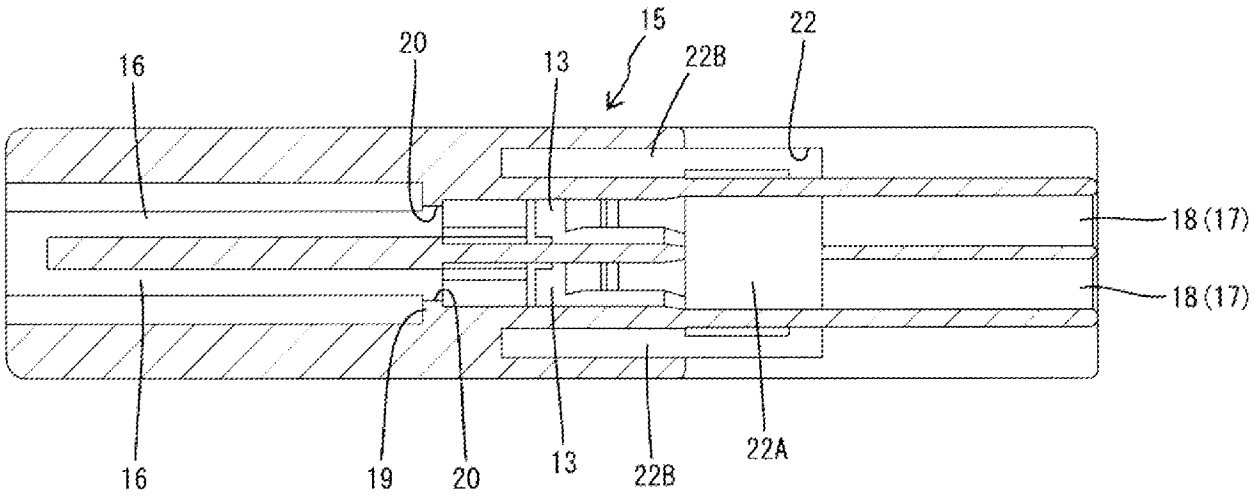
FIG. 8 is a plan view in section of the housing.
Figure 13:
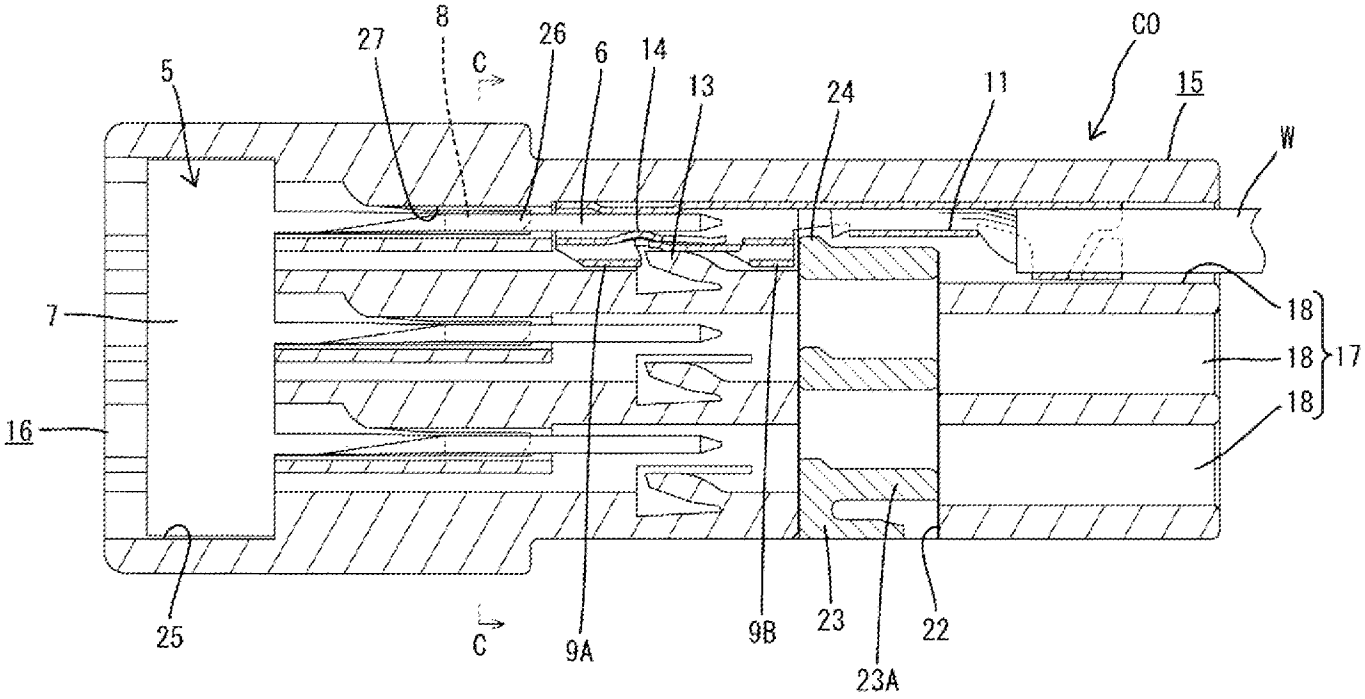
FIG. 13 is a front view in section showing a state where the joint terminal is inserted to a proper depth into the first terminal accommodating portion of the housing.

Next, the first terminal accommodating portions 16 are described. As shown in FIG. 7, the first terminal accommodating portions 16 are arranged in two rows along the Y direction. As shown in FIG. 13, coupling piece accommodating portions 25 into which the coupling pieces 7 of the joint terminals 5 are to be accommodated are formed in entrance parts of the first terminal accommodating portions 16. An opening width of the coupling piece accommodating portion 25 is slightly smaller than a width of the coupling piece 7 of the corresponding joint terminal 5. Thus, in a state where the joint terminal 5 is accommodated in the first terminal accommodating portion 16, the front end edge of the coupling piece 7 butts against the back wall of the first terminal accommodating portion 16 and the coupling piece 7 is somewhat press-fit into the coupling piece accommodating portion 25 so that the entire coupling piece 7 is retained.

Figure 9:
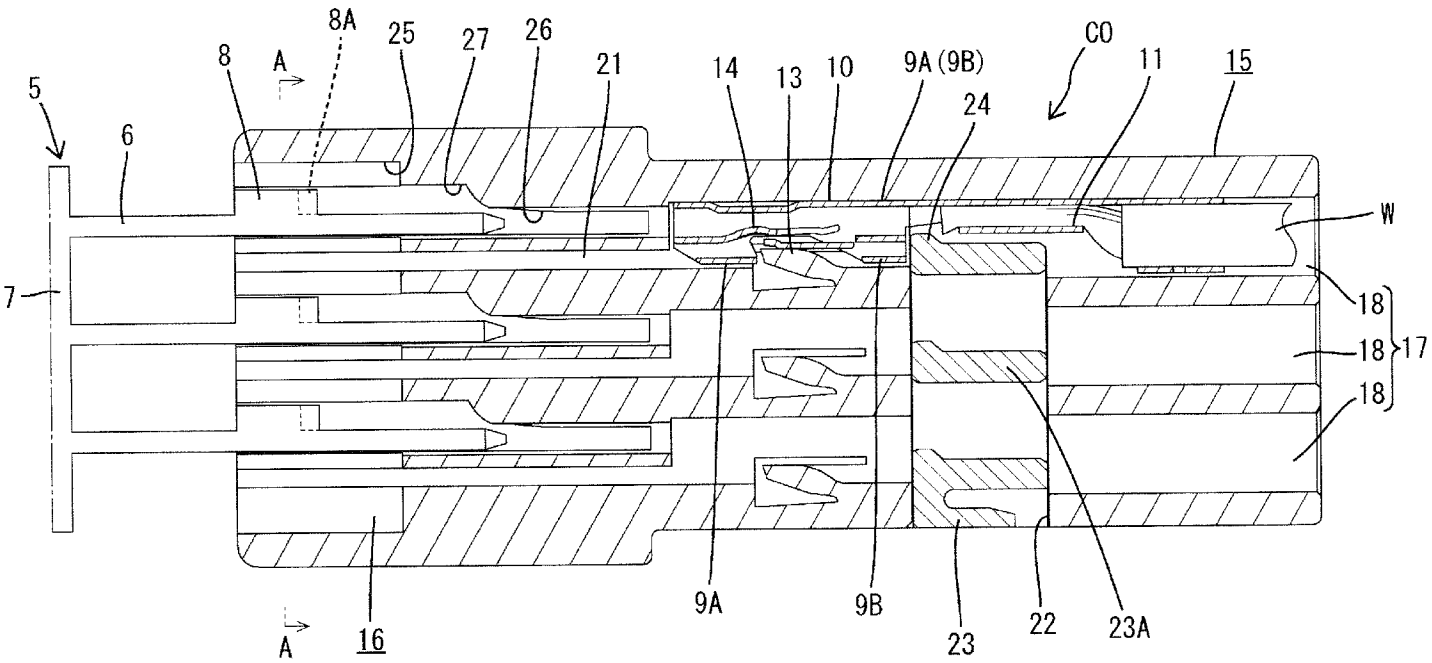
FIG. 9 is a front view in section showing a state where the joint terminal is shallowly inserted in a first terminal accommodating portion of the housing.
Figure 10:
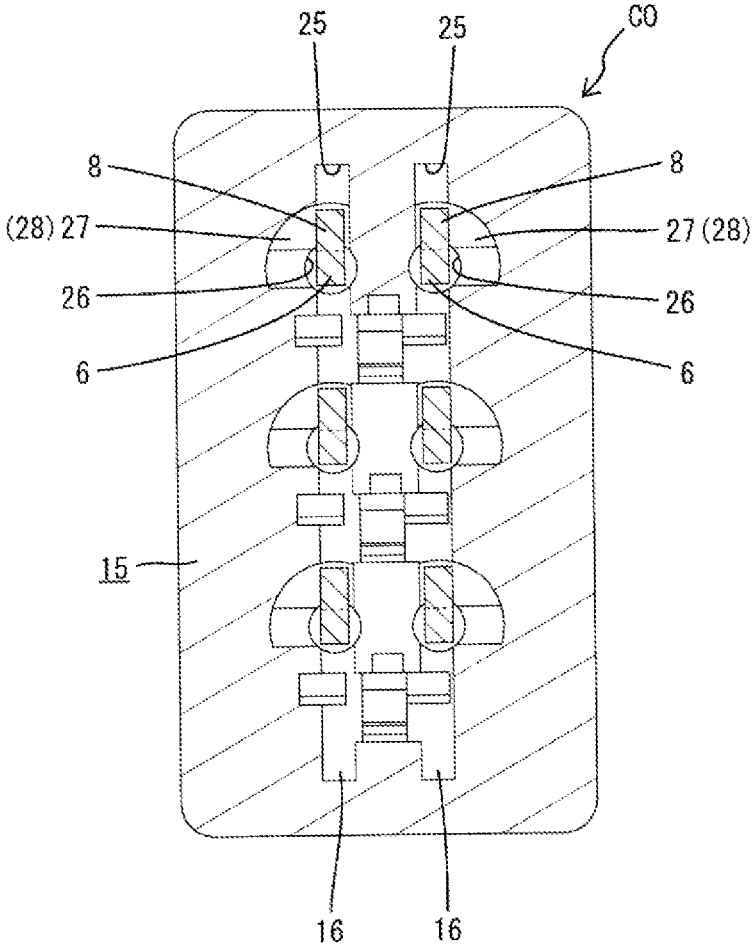
FIG. 10 is a section along A-A of FIG. 9.

As shown in FIGS. 7, 9 and 10, three tab entrance paths 26 are formed in parallel along the X direction in each of the first terminal accommodating portions 16, and each tab terminal 6 of the joint terminal 5 is insertable into each tab entrance path 26. Each tab entrance path 26 is formed straight along the front-rear direction and each tab terminal 6 of the joint terminal 5 is insertable therein. Each tab entrance path 26 is formed straight along the front-rear direction and is substantially coaxial with the corresponding cavity. An entrance part of each tab entrance path 26 communicates with the coupling piece accommodating portion 25. The front end of each tab entrance path 26 is open as the aforementioned insertion hole 20 in the boundary wall 19. As shown in FIG. 7, the tab entrance path 26 is a substantially circular hole having a larger diameter than an outer diameter of the tab terminal.

Figure 15:
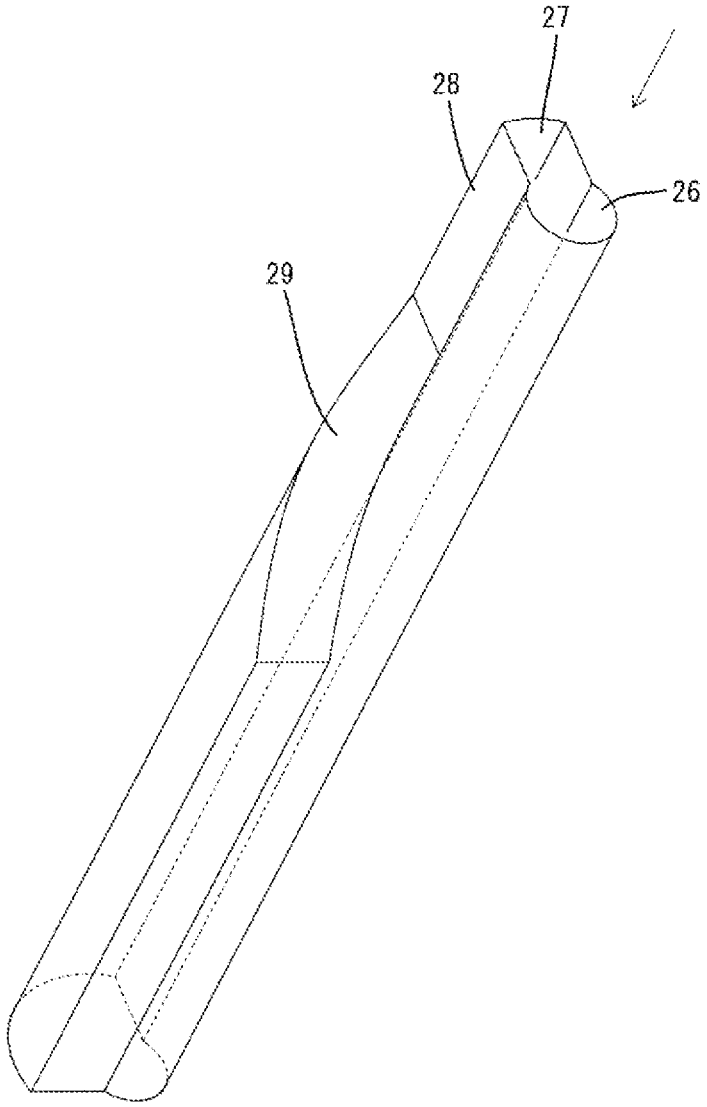
FIG. 15 is a perspective view schematically showing a tab entrance path and a cam portion.
Figure 16:
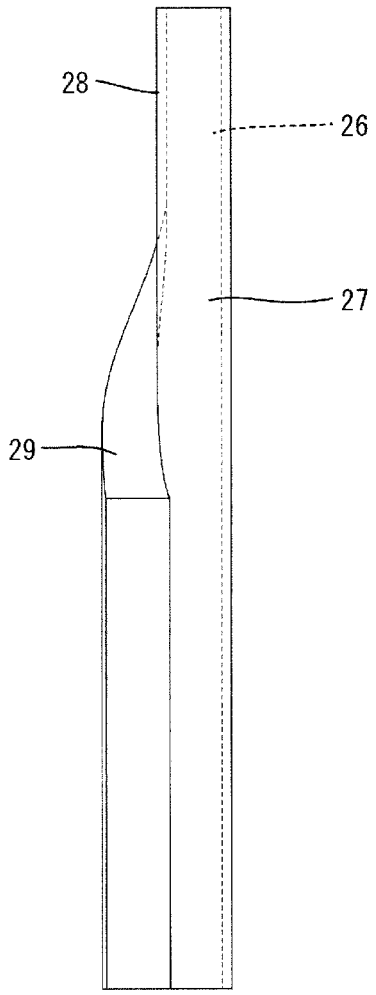
FIG. 16 is a front view schematically showing the tab entrance path and the cam portion.

As shown in FIGS. 15 and 16, the cam portion 27 communicates with each tab entrance path 26 over the entire length of the tab entrance path 26. The cam portion 27 is formed to have a thickness substantially equal to or slightly larger than a plate thickness of the follower portion 8 and the follower portion 8 can enter the cam portion 27. As shown in FIGS. 15 and 16, a part of the cam portion 27 from the entrance of the first terminal accommodating portion 16 (rear end of the housing 15) to a position slightly behind the entrance serves as a straight portion 28. A spiral portion 29 is formed in a length range on a side before the straight portion 28. The spiral portion 29 is formed to spirally turn about an axis of the tab entrance path 26. In the case of this embodiment, a turning angle from the start end to the final end of the spiral is substantially 90°. The cam portion 27 is formed to reach a front end while maintaining a cross-sectional shape at the final end of the spiral also on a side before the final end of the spiral.

Figure 12:
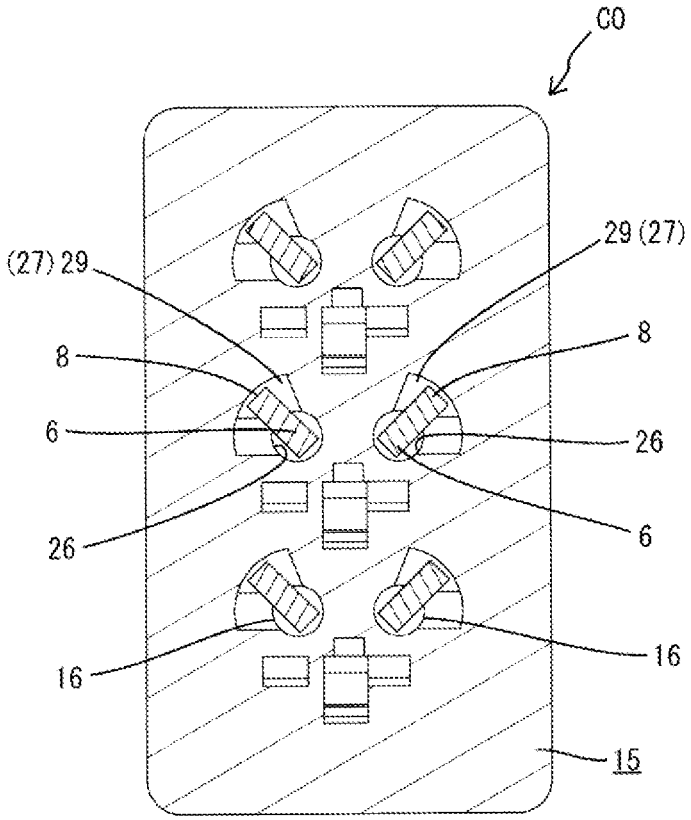
FIG. 12 is a section along B-B of FIG. 11.
Figure 14:
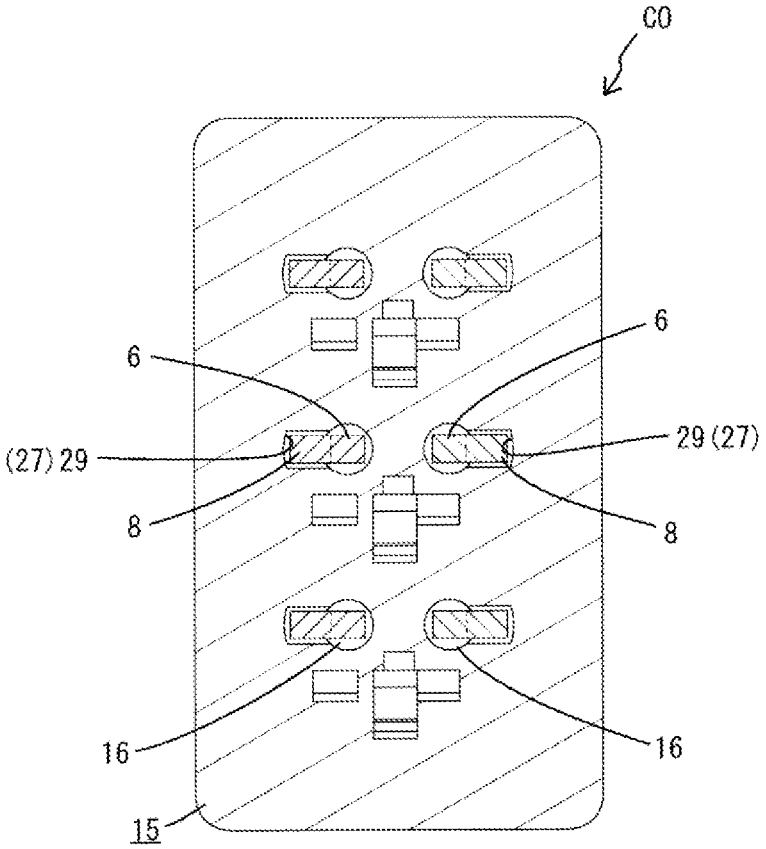
FIG. 14 is a section along C-C of FIG. 13.

However, spiral turning directions are opposite between the first terminal accommodating portions 16 paired in the Y direction. For example, in FIGS. 10, 12 and 14, the turning direction is clockwise in the first terminal accommodating portion 16 located in an upper row in the Y direction, whereas the turning direction is counterclockwise in the first terminal accommodating portion 16 located in a lower row.

Figure 11:
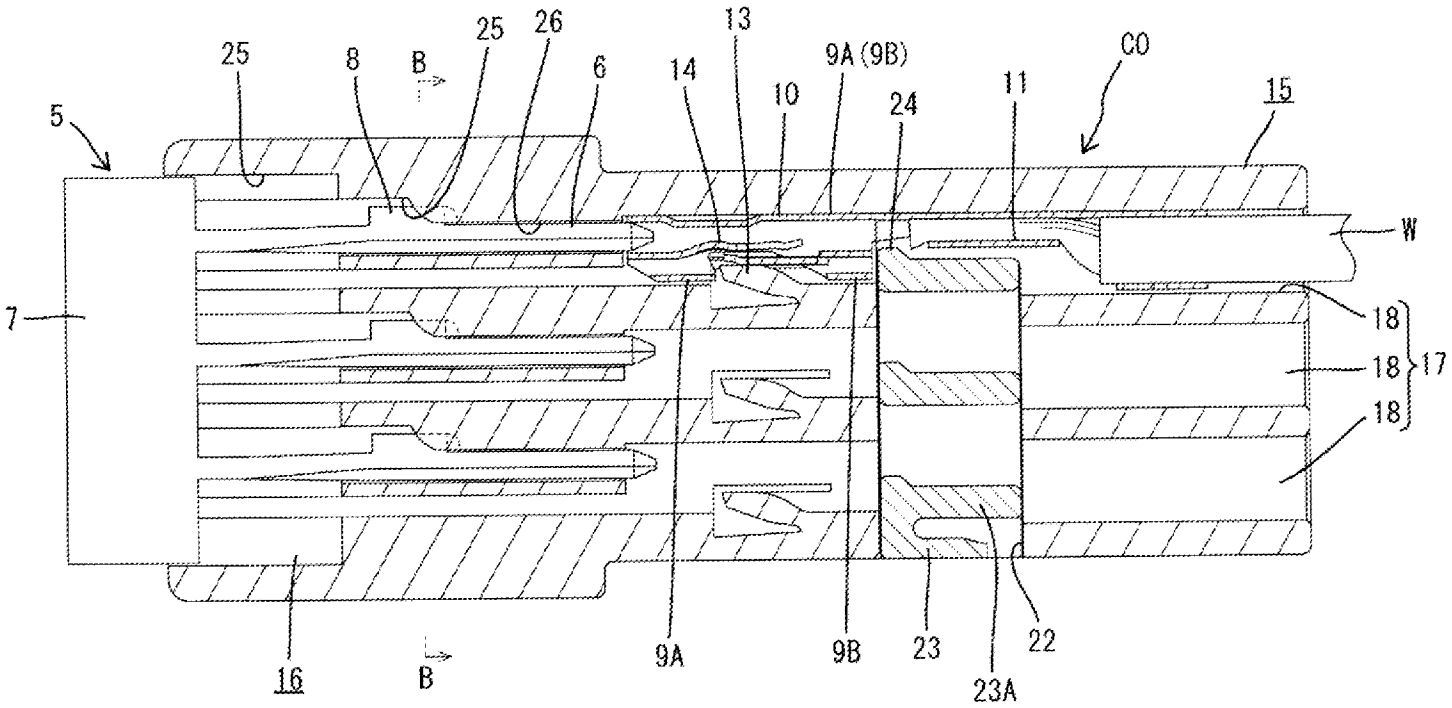
FIG. 11 is a front view in section showing a state where the joint terminal is inserted to an intermediate position into the first terminal accommodating portion of the housing.

In the process of inserting the joint terminal 5 into the first terminal accommodating portion 16 in this way, the follower portion 8 of each tab terminal 6 initially moves forward along the straight portion 28 of the cam portion 27 so that the tab terminal 6 is not deformed. However, as shown in FIG. 11, when the follower portion 8 enters the spiral portion 29 of the cam portion 27, a front end part of the coupling piece 7 of the joint terminal 5 enters the coupling piece accommodating portion 25 and is sandwiched in a plate thickness direction. Thus, as the follower portion 8 moves along a spiral path of the spiral portion 29 thereafter, each tab terminal 6 is twisted and deformed about an axis thereof. As a result, the phase of the follower portion 8 is shifted substantially by 90° from that of the coupling piece 7. In other words, when the joint terminal 5 is first inserted into the first terminal accommodating portion 16, a plate surface direction of the tab terminal 6 is a direction along the Y direction. However, when the insertion of the joint terminal 5 into the first terminal accommodating portion 16 is completed, the plate surface direction of the tab terminal 6 is converted into the X direction.

Note that since the follower portion 8 is located in a front end part of the spiral portion 29 and sandwiched in the plate thickness direction by facing inner wall surfaces of the spiral portion 29 in a state where an inserting operation of the joint terminal 5 is completed, a return (springback) from the twisted and deformed state is restricted.

Next, an example of a manufacturing procedure of the joint connector CO is described. First, the joint terminals 5 are accommodated into the first terminal accommodating portions 16. In that case, each follower portion 8 is inserted into the straight portion 28 of the corresponding cam portion 27 at the same time as each tab terminal 6 of the joint terminals 5 is inserted into the corresponding tab entrance path 26 (see FIGS. 9 and 10).

When the joint terminal 5 is pushed farther in that state, the front end part of the coupling piece 7 enters the entrance part of the coupling piece accommodating portion 25 as shown in FIG. 11. Thus, the coupling piece 7 is sandwiched in the plate surface direction by the facing wall surfaces in the coupling piece accommodating portion 25. On the other hand, since each follower portion 8 enters the entrance part of the spiral portion 29, the follower portion 8 receives a twisting force of a predetermined direction about the axis of the tab terminal 6 from the inner surface (cam surface) of the spiral portion 29 as the joint terminal 5 is pushed.

When the front end of the coupling piece 7 butts against the back wall of the first terminal accommodating portion 16, the insertion of the joint terminal 5 is completed. Since both side edges of the coupling piece 7 in the longitudinal direction are somewhat press-fit to bite into the facing walls in the coupling piece accommodating portion 25 at this time, the entire joint terminal 5 is retained and accommodated in the first terminal accommodating portion 16. On the other hand, each follower portion 8 has reached the front end part of the spiral portion 29 by this time and each tab terminal 6 has been twisted by 90° about the axis thereof until the follower portion 8 reaches here. As a result, as described above, the plate surfaces of each tab terminal 6 were initially facing in the Y direction, which is the same direction as the plate surface direction of the coupling piece 7, but the tab terminal 6 is twisted by 90° and the plate surface direction thereof is converted into the X direction when the joint terminal 5 is completely accommodated.

Next, the connection of the main line female terminals 9A and the branch line female terminal 9B to the respective tabs of the joint terminal 5 is described.

As shown in FIG. 1, the main line 1 includes the bypass 4 for each branch point 3 toward each electronic control unit U. Each bypass 4 is composed of the forward path 4A toward the joint connector CO and the return path 4B returning again to the main line 1 from the joint connector CO. The main line female terminals 9A are connected respectively to the end parts of the wires W of the twisted pair cable serving as the forward path 4A and the end parts of the wires W of the twisted pair cable serving as the return path 4B. Further, the branch line female terminals 9B are connected respectively to the end parts of the wires W of the twisted pair cable serving as the branch line to be connected to each electronic control unit U.

Then, as shown in FIG. 1, the two main line female terminals 9A connected to the respective end parts of the twisted pair cable constituting the forward path 4A of the bypass 4 are inserted simultaneously into the cavities 18 on the left end shown in FIG. 1 of the second terminal accommodating portions 17 paired in the Y direction in FIG. 6 (cavities 18 are not shown in FIG. 1) (note that only the main line female terminals 9A and the joint terminal 5 on one side are shown in FIG. 1 for convenience of drawing preparation). Similarly, the two main line female terminals 9A connected to the return path 4B of the bypass 4 are inserted simultaneously into the cavities 18 in the center shown in FIG. 1 of the two second terminal accommodating portions 17 paired in the Y direction. Further, the two branch line female terminals 9B are inserted simultaneously into the cavities 18 on the left end shown in FIG. 1 of the two second terminal accommodating portions 17 paired in the Y direction.

Note that in the case of inserting any pair of female terminals into the corresponding pair of cavities, the twisted pair cable is in a state where the wires are kept twisted and close to each other without being untwisted. Further, as described above, when the respective female terminals 9A, 9B are inserted into the cavities 18, the retainer 23 is held at the partial locking position.

When the female terminals 9A, 9B connected to the respective wires W of the twisted pair cable are inserted simultaneously into the cavities 18 corresponding in the Y direction in this way, the terminals move forward while deflecting the same integral locking lance 13. When the front protrusions 12A pass the locking lance 13, the locking lance 13 resiliently returns. As a result, the two female terminals 9A, 9B are locked together by the locking lance 13, thereby entering a primarily locked state. The retainer 23 then is moved from the partial locking position to the full locking position, and each locking projection 24 of the retainer 23 locks the rear end of the terminal connecting portion 10 of the corresponding female terminal 9A, 9B. Thus, each female terminal 9A, 9B is retained doubly by the locking lance 13 and the locking projection 24.

When each female terminal 9A, 9B is inserted properly into the corresponding cavity 18, as described above, the corresponding tab terminal 6 of the joint terminal 5 enters the terminal connecting portion 10 of each female terminal 9A, 9B. In this process, the tab terminal 6 slides in contact with the resilient contact piece 14 while deflecting the resilient contact piece 14, thereby being electrically connected. Since the resilient contact piece 14 is in contact with the plate surface of the tab terminal 6 rather than the fracture surface of the tab terminal 6 during this time, the resilient contact piece 14 is not damaged by the fracture surface.

As described above, in the joint connector CO of this embodiment, the two female terminals 9A, 9B connected to the twisted pair cable share one locking lance 13. Thus, a situation where only one female terminal is inserted incompletely and the other female terminal is locked properly does not occur. In that respect, since female terminals conventionally are locked by individual locking lances, a situation is possible where if one female terminal constituting a pair is locked by the locking lance 13, the other female terminal is not pulled out even if being incompletely inserted. However, in this embodiment, the two female terminals 9A, 9B are pulled out together from the cavities 18 in such a case. Thus, the twisted pair cable need not be untwisted at the entrance parts of the cavities 18 as before and can be inserted into the cavities while being kept in a twisted state. Therefore, the wires W are kept close to each other and, hence, a noise reduction function is not impaired.

Further, since the two female terminals 9A, 9B are conventionally locked by individual locking lances, a sufficient terminal holding force may not be obtained due to a reduction in the rigidity of the locking lances themselves if the locking lances become narrower with the miniaturization of terminals. However, since the common locking lance 13 is wide in this embodiment, a high holding force can be obtained for the female terminals 9A, 9B.

The joint connector CO of this embodiment also has the following functions and effects. Specifically, the branch points 3 of the main line 1 are connected by relaying the joint terminals 5 and the main line female terminals 9A for forward and return paths in the bypasses 4. By connecting each branch point 3 in this way, the entire main line 1 is configured. Further, each electronic control unit U is connected while being branched from the main line 1 by connecting the joint terminals 5 and the branch line female terminals 9B at each branch point 3. By connecting each branch point 3 in this way, the in-vehicle network is built and communication is possible among the electronic control units U.

Further, according to this embodiment, the deflection direction of the locking lance 13 is set not in the arrangement direction (Y direction) of the cavities for accommodating the pair of female terminals 9A, 9B connected to each twisted pair cable, but in the direction (X direction) perpendicular to this direction. Thus, an interval between the cavities for accommodating the pair of female terminals 9A, 9B can be narrowed. Thus, at a connected part to the connector, a high noise removal function of the twisted pair cable can be maintained also in the cavities. Further, even if the positions of the locking lances 13 are changed in adopting such a configuration, the resilient contact pieces 14 of the female terminals are not in contact with the fracture surfaces of the tab terminals 6 of the joint terminals 5 and can be protected from damage since the tab terminals 6 are twisted substantially by 90° about the axes. In addition, since the tab terminals 6 are not twisted beforehand, but twisted as being inserted into the housing 15 of the joint connector CO, the manufacturing efficiency of the joint connector can be enhanced since there is no pre-processing.

Furthermore, according to this embodiment, the follower portions 8 are located in the front end parts of the spiral portions 29 and sandwiched in the plate thickness direction by the facing inner wall surfaces of the spiral portions 29 in the state where the inserting operation of the joint terminal 5 is completed. Thus, there is no return (springback) of each tab terminal 6 from the twisted and deformed state. Therefore, it is also possible to obtain an effect that the tab terminal 6 can be stably in contact with the plate surface of the resilient contact piece 14 of the corresponding female terminal 9A, 9B.

The invention is not limited to the above described and illustrated embodiment. For example, the following embodiments are also included in the scope of the invention.

Although the present invention is applied to the joint connector used in the in-vehicle network in the above embodiment, the use and form of the connector should be not limited. For example, although the joint terminals and the female terminals are accommodated together into one housing in the above embodiment, the present invention may be applied to female connectors for accommodating only female terminals.

Although the locking lance locks the female terminals in the above embodiment, the locking lance may, of course, lock male terminals.

Although the common unlocking portion is arranged in the widthwise central part of the front end part of the locking lance in the above embodiment, the common unlocking portion may be arranged, for example, at least on one widthwise end part. In short, the disposed position of the common unlocking portion should not be limited provided that the common unlocking portion is provided at such a position that the locking lance can be deflected and deformed in an unlocking direction in a balanced manner in the width direction without being twisted or the like when the common unlocking portion is operated.

LIST OF REFERENCE SIGNS

9A . . . main line female terminal (terminal)
9B . . . trunk line female terminal (terminal)
13 . . . locking lance
15 . . . housing
18 . . . cavity
30 . . . common unlocking portion
W . . . wire
CO . . . joint connector (connector)

The invention claimed is:

1. A connector, comprising:

a twisted pair cable formed by twisting two wires;

two terminals connected to respective ends of the two wires of the twisted pair cable, each of the terminals having a locking part;

a housing formed with two adjacent cavities for individually accommodating the two terminals, the two adjacent cavities being spaced apart in an arrangement direction; and a locking lance arranged in the housing and being deflectable in a deflection direction that is substantially perpendicular to the arrangement direction, the locking lance having a width extending parallel to the arrangement direction, the width being dimensioned so that the locking lance is capable of simultaneously locking the locking parts formed on both of the terminals, wherein the terminals connected to the twisted pair cable are accommodated into the two adjacent cavities and the locking lance simultaneously locks the terminals in the adjacent cavities.

2. A connector, comprising:

a twisted pair cable formed by twisting a pair of wires;

a pair of terminals connected to respective ends of the twisted pair cable;

a housing formed with cavities for individually accommodating the terminals; and a locking lance deflectably arranged in the housing and capable of locking a locking part formed at one position of each of the terminals, wherein the terminals connected to the twisted pair cable are accommodated into adjacent ones of the cavities and the locking lance integrally and interlockably formed to straddle between the adjacent cavities is formed in the adjacent cavities, wherein a common unlocking portion for unlocking the terminals is formed in a front part of the locking lance.

3. The connector of claim 2, wherein a pair of removal holes for molding both side surface parts of the locking lance are open in side surfaces of the housing, the removal holes communicate with a retainer mount hole for mounting a retainer for locking the terminals, and openings of the removal holes are closed by the retainer with the retainer mounted in the housing.

4. The connector of claim 3, wherein an arrangement direction of the cavities for accommodating the pair of terminals connected to the twisted pair cable is set in a direction perpendicular to a deflection direction of the locking lance.

5. A connector, comprising:

a twisted pair cable formed by twisting a pair of wires;

a pair of terminals connected to respective ends of the twisted pair cable;

a housing formed with cavities for individually accommodating the terminals; and a locking lance deflectably arranged in the housing and capable of locking a locking part formed at one position of each of the terminals, wherein the terminals connected to the twisted pair cable are accommodated into adjacent ones of the cavities and the locking lance integrally and interlockably formed to straddle between the adjacent cavities is formed in the adjacent cavities, and wherein a pair of removal holes for molding both side surface parts of the locking lance are open in side surfaces of the housing, the removal holes communicate with a retainer mount hole for mounting a retainer for locking the terminals, and openings of the removal holes are closed by the retainer with the retainer mounted in the housing.

6. The connector of claim 5, wherein an arrangement direction of the cavities for accommodating the pair of terminals connected to the twisted pair cable is set in a direction perpendicular to a deflection direction of the locking lance.

* * * * *